United States Patent [19]

Lamlee

[11] 3,971,156

[45] July 27, 1976

[54] INTERCHANGEABLE-FACE DEVICES AND METHOD OF MAKING SAME

[76] Inventor: Stewart Lamlee, 55 W. 86th St., New York, N.Y. 10024

[22] Filed: Oct. 8, 1975

[21] Appl. No.: 620,808

[52] U.S. Cl. ..... 46/1 L; 46/36; 273/155

[51] Int. Cl.[2] ..... A63H 33/14

[58] Field of Search ..... 46/1 L, 35–37, 46/157; 273/155

[56] References Cited

UNITED STATES PATENTS

| | | | |
|---|---|---|---|
| 1,330,043 | 2/1920 | Offutt et al. | 46/157 |
| 1,997,022 | 4/1935 | Stalter | 46/1 L |
| 2,883,195 | 4/1959 | Rodgers et al. | 273/155 |
| 3,302,321 | 2/1967 | Walker | 46/1 L |
| 3,866,815 | 1/1975 | Desmond | 46/35 |

*Primary Examiner*—Louis G. Mancene
*Assistant Examiner*—Robert F. Cutting
*Attorney, Agent, or Firm*—Sydney B. Schlessel

[57] ABSTRACT

An improved interchangeable-face device comprising two rows of alternately disposed equilateral triangles, spaced apart from one another and joined by link members bridging the interspaces, bonded to opposing surfaces of a pliant intermediate binder element, whereby the triangles and their interspaces are in registry, with the exposed portions of the binder element forming hinges for adjoining triangles. The triangle faces are provided with corresponding representations and the triangles are schematically overlaid upon one another, with the end triangles bonded together, to form a polygon, the latter adapted to be flexed for progressive exposure of groups of triangle faces, each group defining a different composite representation.

8 Claims, 12 Drawing Figures

Fig.1.
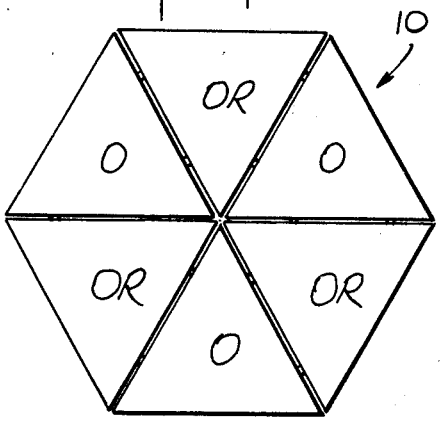
Fig.3.
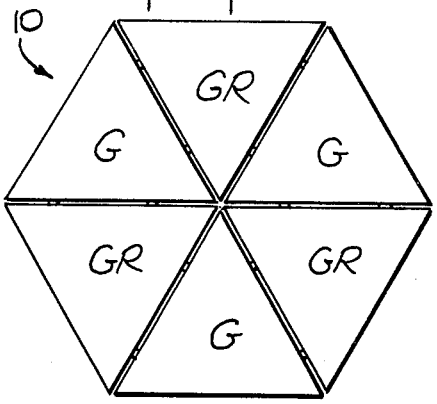
Fig.2.
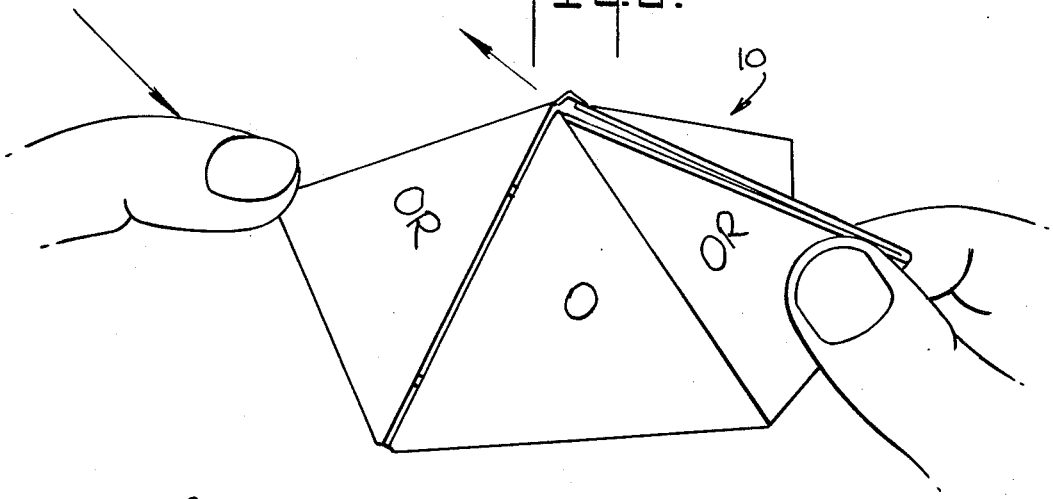
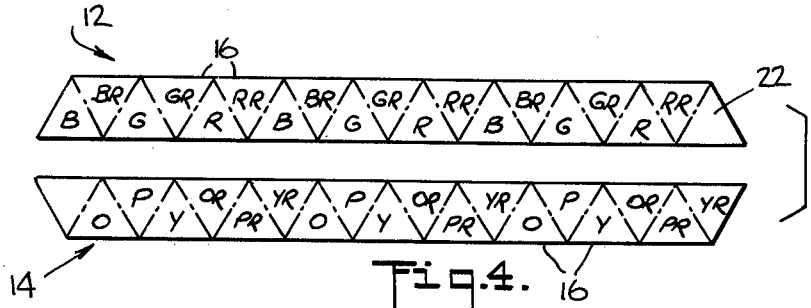
Fig.4.
Fig.11.
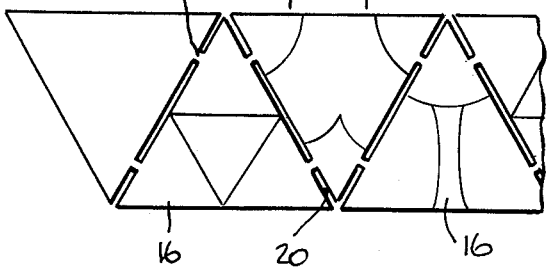
Fig.12.
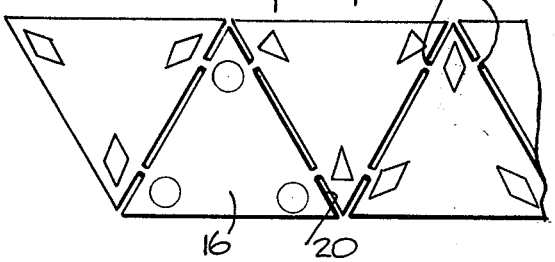

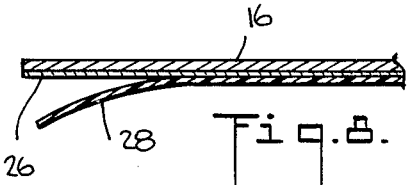
Fig. 8.
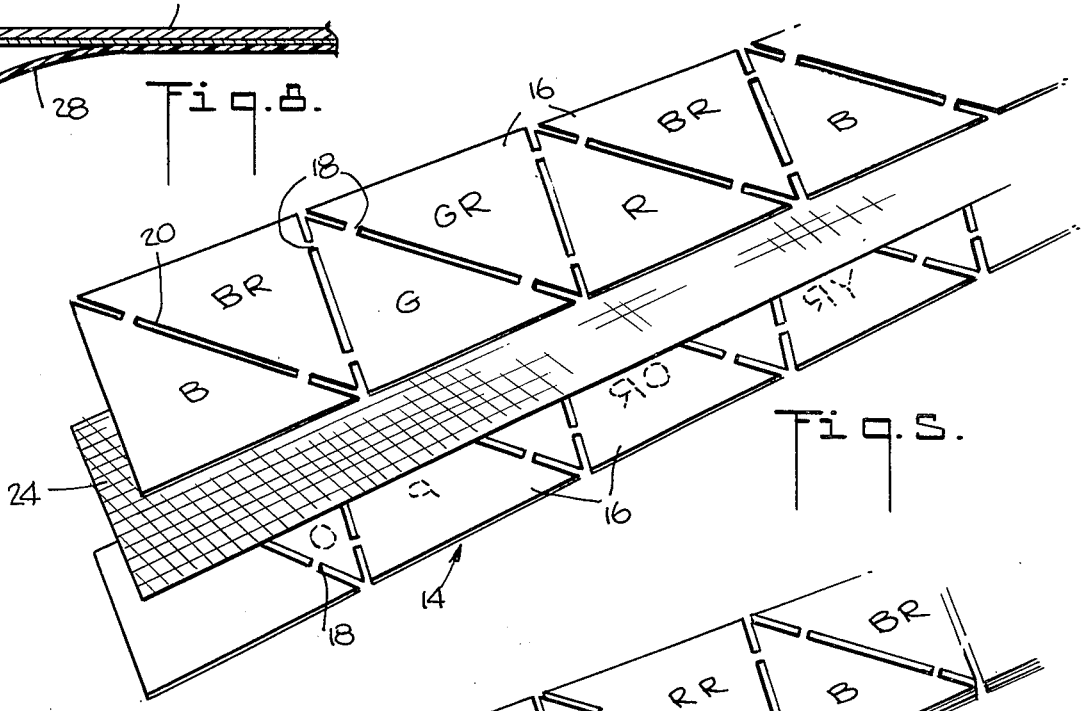
Fig. 5.
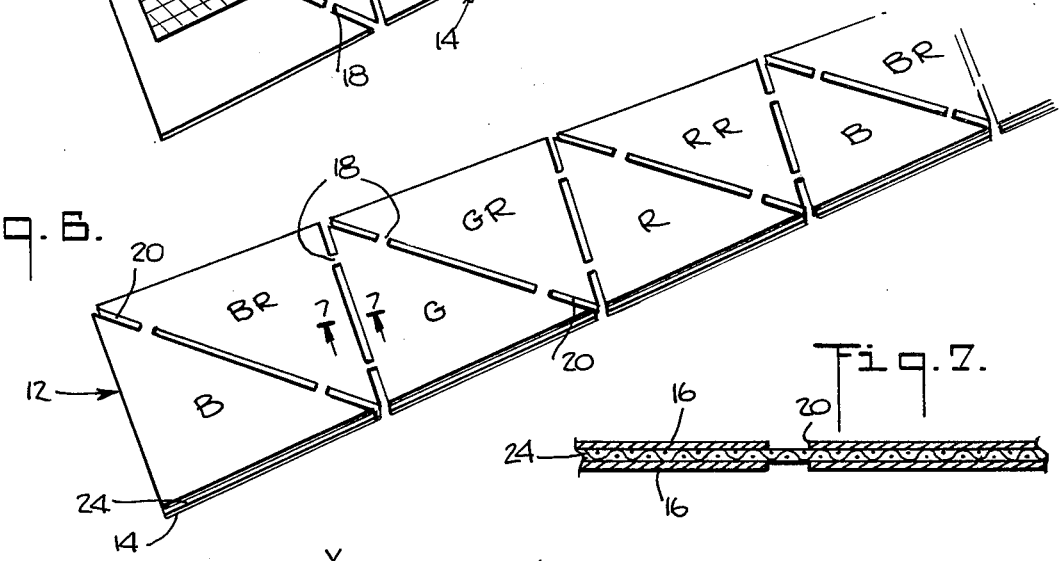
Fig. 6.
Fig. 7.
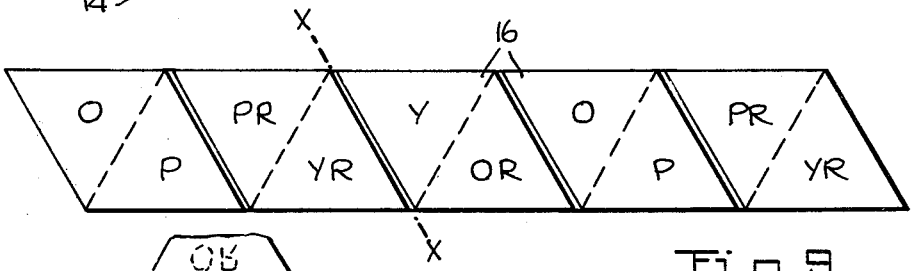
Fig. 9.
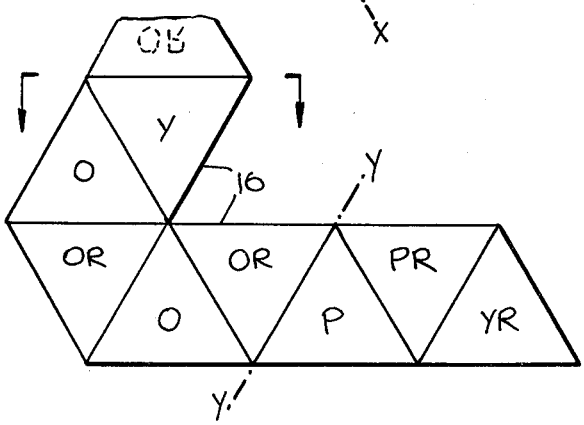
Fig. 10.

INTERCHANGEABLE-FACE DEVICES AND METHOD OF MAKING SAME

BACKGROUND OF THE INVENTION a. Field of the Invention

This invention relates to the field of interchangeable-face devices, which may be used for amusement, presenting advertisement material, etc.. It has for its particular objective the creation of an improved interchangeable-face device comprising two sets of equal numbers of equilateral triangles, with one set bonded to each surface of an intermediate binder element adapted to act as hinges between adjoining triangles of the combination, the two sets of triangles being in registry with each other so that each set acts as one set of faces of the resulting combination. The triangles are schematically overlaid, with the end triangles secured together, to form a polygonal structure. Graphic representations schematically provided on the faces of the triangles form a composite representation for the over-all exposure of a set of exposed triangle faces. With inversion of the set of faces shown, a different set of faces is exposed, providing a different composite represention. with the previous set of faces hidden. Depending on the number of triangles used to make up the complete structure of the polygon, as many as 16 or more different combinations of representations can be selectively exposed and re-exposed.

b. Prior Art

In the present state of the art there are polygonal devices of the type described, so arranged, depending upon the number of triangles used to form the device, as to form such polygonal figures as hexagons, etc.. These devices are so constructed that by pinching two adjoining triangle surfaces together, while pulling the apices of opposing triangles in the opposite direction, the exposed triangle faces will be turned outwardly to expose a different set of faces, with the former set now hidden from view. This form and manner of "flexing" the device to serially expose different sets of faces have led them to be called flexagons, such as hexaflexagons, etc., depending upon the number of sides of the device, and capable of exposing 6,15 or more hexagonal surfaces, each set appearing to have a different design. The disadvantages found with present types of flexagons depend on the nature of their construction. Some are created by folding strips of paper to form the equilateral triangles, the folds becoming the hinges between adjoining triangles, by means of which the device is "flexed" and the surfaces changed. Obviously, after a number of such "flexes" or changes the folds disintegrate, and the device becomes worthless. In other instances the triangles are individually cut out, or formed, of paper, cardboard, metal, etc., and thereafter joined together, with tape strips to act as hinges, or by gluing them along a long strip of tape. The obvious disadvantages to this construction lie in time and labor used in forming the individual triangles and taping them together, as well as the difficulty in taping them so that the hinge portions of the tape are neither too binding nor too slack. Also, the finished product does not present an aesthetic appearance.

BRIEF SUMMARY OF THE INVENTION

The aforementioned disadvantages are overcome by my invention, which provides for die-cutting, or stamping, two rows of triangles for the polygon, with the triangles in each row spaced apart but held together as a unit by interconnecting link portions bridging the interspaces, until assembly, and thereafter securing each row of triangles to one surface of a pliant intermediate binder element, whereby the two rows of triangles and their interspaces come into registry on either side of the binder element to form a single row of triangles. While the link members may remain in the interspaces they do not interfere with the overlaying of the triangles, in assembly and use, with the binder element bridging the interspaces becoming the hinges between adjoining triangles. Prior to the die-cutting, or stamping, of the triangle units, or thereafter, the faces of the triangles are provided with schematic graphic representations aforementioned.

It is therefore an important object of my invention to provide an improved interchangeable-face device of greater durability, far outlasting present types of construction and use.

A second important object of my invention lies in the provision of an interchangeable-face device, which greatly reduces the time and labor involved in the construction of present types.

Still another important object of my invention lies in the creation of a device of the type described, wherein the spacing of the triangles is mechanically uniform, for flexing and without slack.

Still another important object of my invention lies in the provision of a device of the type described which permits greater facility in providing the graphic representations, or symbols, for the triangle faces, since they may be provided either prior or subsequent to assembly of the completed device, prior to formation of the polygon.

These and other salient objects, advantages and functional features of my invention will become more readily apparent from an examination of the following description, taken with the accompanying drawings, wherein:

BRIEF DESCRIPTION OF THE DRAWINGS

FIG. 1 is a top view of a preferred embodiment of my invention, commonly termed a hexaflexagon;

FIG. 2 is a perspective view of the embodiment of FIG. 1, in the process of exposing a different set of faces;

FIG. 3 is a top view of the embodiment of FIG. 1, showing the different set of faces exposed;

FIG. 4 is a reduced view showing the top and bottom surfaces of the device, each row of triangles formed as a unit;

FIG. 5 is an enlarged, exploded perspective view, in broken section, showing the upper and lower rows of triangles of FIG. 4, and the intermediae binder element;

FIG. 6 is a view similar to FIG. 5, but showing the parts thereof bonded together;

FIG. 7 is a cross-sectional view, taken on lines 7-7 of FIG. 6;

FIG. 8 is a cross-sectional view of one of the triangles, showing one form of application of adhesive for binding to the binder element;

FIGS. 9 and 10 show the procedure for overlaying the triangles to form the final device shown by FIG. 1; and FIGS. 11 and 12 are broken sections of triangle units showing variations of surface graphic representations.

Similar reference characters designate similar parts throughout the different views.

DETAILED DESCRIPTION OF THE INVENTION

Illustrative of the embodiment shown by the drawings, my interchangeable-face device 10, which, in this embodiment, forms a hexaflexagon, is formed by die-cutting, or otherwise stamping out, two rows 12 and 14 of 19 equilateral triangles 16 each, the triangles 16 formed in alternate positions, and each spaced from its adjacent triangle or triangles, as shown in FIGS. 5 and 6, an equal distance, with the triangles 16 being held together by link members 18, which may be scored centrally for breakage after final assembly, so that each row 12 and 14 remains, until then, a complete unit. The rows 12 and 14 are preferably made from sheets of substantially rigid but flexible cardboard or plastic material, although other suitable material may be substituted, so that the triangle faces are fairly firm and the link members 18 sufficiently strong to hold the triangles together until final assembly, the spacing between triangles 16 being of a distance as will hereinafter be disclosed. The first 18 triangles 16 of row 12 are then imprinted, embossed or otherwise provided with representations, graphic or otherwise, schematically, as shown by FIG. 4. In this illustration colors are used, but numbers, designs, or other representations may be substituted or included, and the last triangle 16 is left blank, coated with a pressure-sensitive adhesive 22. The first triangle 16 of the bottom row 14 is likewise left blank, with the remainder of the triangles similarly provided with representations schematically, in the manner above described.

For convenience color design has been shown in the illustration by numeral, specific colors indicated as follows:

| | |
|---|---|
| B—blue design | BR—blue reverse design |
| G—green design | GR—green reverse design |
| R—red design | RR—red reverse design |
| Y—yellow design | YR—yellow reverse design |
| P—pink design | PR—pink reverse design |
| O—orange design | OR—orange reverse design |

While the use of "reverse", with color, serves no purpose other than to indicate pairs of triangles, it becomes important in using shapes, designs, etc., since the latter must come into registry when triangle pairs are overlaid, since they have alternate apices, that is to say, the design or shape must be reversed to match its corresponding triangle.

Following the schematice pattern for color, the colors for top row 12, of triangles 16, are B, BR, G, GR, R, RR, and the scheme repeated for the remaining triangles, other than the last, which remains blank, while the schematic pattern for the bottom row 14, after the first blank triangle, is O, P, Y, OR, PR, YR, etc., as shown in FIG. 4.

In the embodiment shown, there is provided a binder element 24, matching the length and width of rows 12 and 14, composed of a sheet of durable, pliant material, such as nylon, to one surface of which row 12 is bonded, and to the other surface of which row 14 is bonded, so that the triangles 16 and interspaces 22 of the respective sets 12 and 14 come into registry, as shown by FIGS. 5, 6 and 7, whereby the exposed portions of the binder element 24 act as hinges between adjoining triangles 16. In the embodiment illustrated the rows 12 and 14 are bonded to the binder element 24 by adhesive coatings 26 provided on the undersurfaces of rows 12 and 14, and protected, prior to assembly, by a removable layer 28, as shown by FIG. 8. However, instead of such adhesive coating 26 and protective layer 28, the undersurfaces of the triangle rows 12 and 14 may be sprayed with adhesive before assembly with the binder element 24, or both surfaces of the latter may be so sprayed or adhesive otherwise applied.

Referring now to the spacing of the triangles 16 from one another in each of the rows 12 and 14, they are equally spaced from adjoining triangles a distance equal to a double thickness of the triangles 16 plus the thickness of the binder element 22, so that, with the assembly of the device 10, the triangles 16 may be overlaid, for the assembly and use of the device 10, upon one another easily, without strain, but also without slack.

FORMING THE INVENTION

In the formation of the hexaflexagon 10, the upper faces of the triangles 16 are overlaid, color to color, thus, B upon BR, G upon GR, etc., to form a row of 9 double triangles 16 and a single final triangle 16 (YR), as shown in FIG. 9. It is then folded along line x—x, as shown in FIG. 9, with YR against Y, to form the shape shown by FIG. 10. The triangles colored PR, P and YR are then folded along line y—y, beneath the remaining triangles, and the blank triangle 16, provided with the pressure-sensitive glue 22, is folded upon the blank triangle beneath it, and secured thereto, to form the hexaflexagon 10 shown in FIG. 1.

OPERATION OF THE INVENTION

Referring now to FIGS. 1, 2 and 3, FIG. 1 shows six faces of triangles 16, all colored orange. As shown by FIG. 2, two of the triangles 16 are pinched together near their bases, while opposing triangles 16 are forced outwardly at their apices. As the opposing triangles 16 are forced outwardly the pinched triangles 16 are released and a different set of faces becomes exposed, as shown by FIG. 3, in which all of the faces are green. In this way other sets of triangle faces are consecutively exposed, with the previously exposed faces thereby concealed.

In the construction of my device 10 as a hexaflexagon, with the number of triangles employed, and with positional changes of their positions, 15 different facial exposures are possible. Where geometric shapes are used for the graphic representations, such as shown by FIGS. 11 and 12, it is possible to have 15 different Kaleidoscopic effects. Color may be combined with shape, etc., and different forms of advertising material may be provided for the triangle faces. It is therefore obvious that variations of graphic representations for the faces of the triangles are limited only by the imagination of the maker.

Hence, it is to be recognized that the embodiment shown and described is by way of illustration and not by way of limitation, and that various changes may be made in the construction, composition and arrangement of parts without limitation upon or departure from the spirit and scope of the invention, or sacrificing any of the advantages thereof inherent therein, all of which are herein and hereby claimed.

Having described my invention, I claim:

1. An improved interchangeable-face device comprising a first row of alternatively disposed equilateral triangles equally spaced apart, with link members bridging the interspaces, to form a single unit thereof, a second row of identical triangles similarly spaced and linked to form a single unit, and an intermediate flat pliant binder element of identical shape, means to bond one row of triangles to each surface of the binder element so as to bring the triangles and interspaces of each row in registry with the other, with the exposed portions of the binder element adapted to act as hinges between adjoining triangles, the triangles being schematically overlaid, with end triangles in registry, and means to bond the end triangles together to form of the device a polygon, the latter adapted to be progressively flexed at one side and extruded at the other to progressively expose different groups of triangle faces.

2. An improved interchangeable-face device as described in claim 1, the faces of all but the last triangle of the first row, and the faces of all but the first triangle of the second row being schematically provided with graphic representations, whereby progressive exposure of each group of triangle faces discloses a different composite representation.

3. The improved interchangeable-face device as described in claim 2, the graphic representations being colors, whereby each group of triangle faces discloses a different composite color.

4. The improved interchangeable-face device as described in claim 2, the graphic representations being portions of designs, whereby each group of triangle faces discloses a different composite design.

5. The improved interchangeable-face device as described in claim 2, the graphic representations being legends, whereby each group of triangle faces discloses a different composite legend.

6. The improved interchangeable-face device as described in claim 1, each of the rows comprising 19 equilateral triangles, the schematic overlaying of which forms a hexagon.

7. The improved interchangeable-face device as described in claim 1, each of the rows of triangles comprising 37 equilateral triangles, the schematic overlaying of which forms a hexahexagon.

8. The method of making an improved interchangeable-face device comprising the steps of stamping out a first row of alernatively disposed equilateral triangles equally spaced apart, with link members bridging the interspaces to define a single unit, stamping out a second row of identical triangles and interspaces as a unit, bonding each of the rows to an opposing surface of a pliant intermediate binder element, whereby the triangles and interspaces of each row come into registry with the other, with exposed portions of the binder element adapted to act as hinges between adjoining triangles, schematically providing graphic representations on the triangle faces, and overlaying the triangles to form a polygon adapted to be flexed by pinching two adjacent triangles together and extruding the opposing triangle, to expose a different group of triangle faces progressively, disclosing a different composite representation.

* * * * *